US005088237A

United States Patent [19]

Nagel et al.

[11] Patent Number: 5,088,237

[45] Date of Patent: Feb. 18, 1992

[54] METHOD, MACHINE AND TOOL FOR THE HONING OF WORKPIECES

[75] Inventors: Peter Nagel, Neuffen; Wolf Nagel, Nuertingen-Zizishausen, both of Fed. Rep. of Germany

[73] Assignee: Nagel Maschinen-und Werkzeugfabrik GmbH, Fed. Rep. of Germany

[21] Appl. No.: 419,082

[22] Filed: Oct. 10, 1989

[30] Foreign Application Priority Data

Oct. 15, 1988 [DE] Fed. Rep. of Germany ..... 3835185

[51] Int. Cl.[5] ..... B24B 5/10

[52] U.S. Cl. ..... 51/34 J; 51/34 H; 51/165.93; 51/290

[58] Field of Search ..... 51/290, DIG. 6, 73 R, 51/34 H, 34 J, 34 K, 34 R, 281 P, 165.91, 165.92, 165.93

[56] References Cited

U.S. PATENT DOCUMENTS

| | | | |
|---|---|---|---|
| 3,029,562 | 4/1962 | Kroen | 51/290 |
| 3,287,860 | 11/1966 | Blake | 51/34 H |
| 3,393,472 | 7/1968 | Sunnen | 51/34 H |
| 4,291,504 | 9/1981 | Fitzpatrick | 51/290 |
| 4,455,789 | 6/1984 | Gehring | 51/165.93 |
| 4,510,720 | 4/1985 | Westberg | 51/165.93 |
| 4,945,685 | 8/1990 | Kajitani | 51/165.93 |

FOREIGN PATENT DOCUMENTS

| | | | |
|---|---|---|---|
| 2460997 | 7/1976 | Fed. Rep. of Germany . | |
| 2462847 | 7/1976 | Fed. Rep. of Germany . | |
| 277262 | 12/1987 | Japan | 51/34 H |
| 282861 | 12/1987 | Japan | 51/34 H |
| 931418 | 6/1982 | U.S.S.R. | 51/34 H |

*Primary Examiner*—James G. Smith
*Assistant Examiner*—B. Shideler
*Attorney, Agent, or Firm*—Eckert Seamans Cherin & Mellott

[57] ABSTRACT

A honing tool for machining a workpiece bore (40) in one working stroke with honing coatings (22) set in fixed manner to the desired size of the bore, has on a non-readjustable part of the tool body (12) and preferably in the vicinity of a guide zone (28), air measuring nozzles (33). During the tool return stroke, these nozzles are subject to an action through the bore and measure the final size of the latter following the working zone (24). Optionally a readjustment can be automatically initiated as a function of the result.

10 Claims, 3 Drawing Sheets

FIG. 1
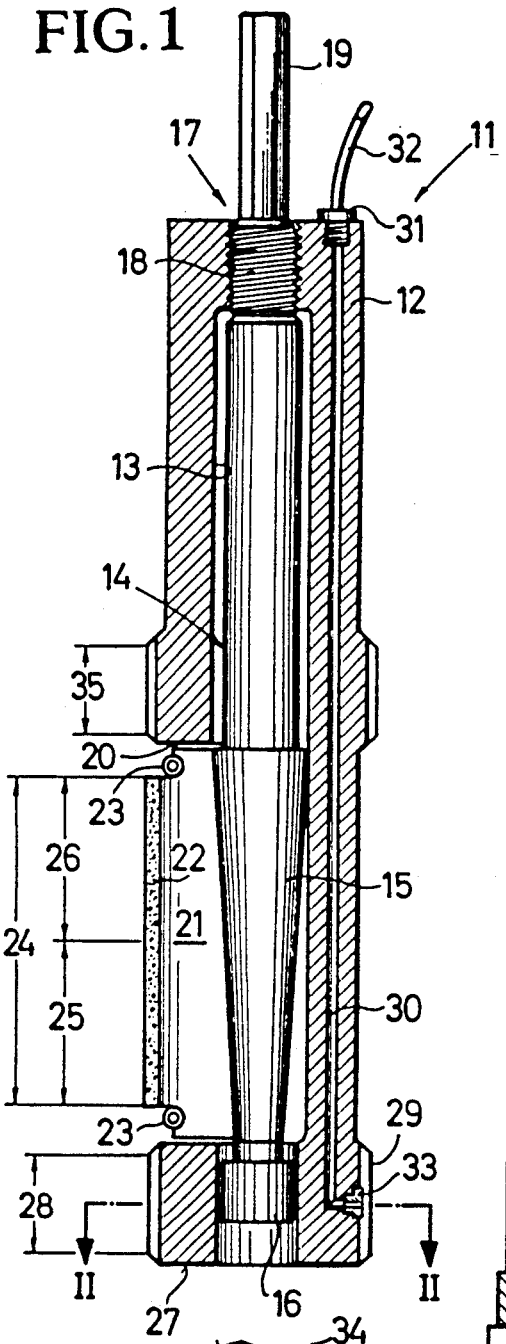
FIG. 3
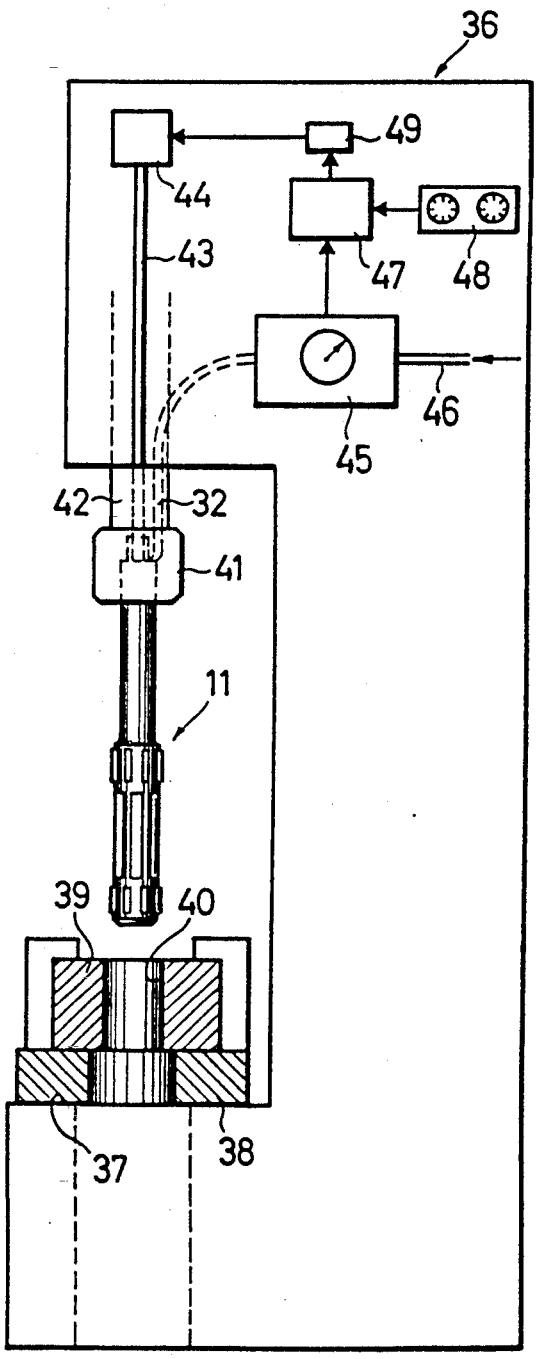
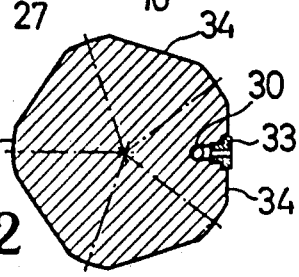
FIG. 2

METHOD, MACHINE AND TOOL FOR THE HONING OF WORKPIECES

BACKGROUND OF THE INVENTION

The invention relates to a method, a honing machine and a tool for the honing of workpieces.

German Patents 24 60 997 and 24 62 847 disclose methods, tools and machines, which perform honing in only one main working stroke, as well as optionally one or more following levelling strokes. Unlike in normal honing, the tool is not widened during working and is instead preset in fixed manner to a diameter corresponding to the desired value and then carries out the machining in a widening cutting zone, which is followed by a calibrating zone. During the tool return stroke there is a recalibration or levelling. In a very short time this tool makes it possible to carry out working with excellent precision and surface quality and has an extremely long service life. The tool normally only has be readjusted after several working strokes.

Attempts have already been made in the series precision working of bores to carry out a check or remeasurement to establish precisely the most favorable time for readjusting the tools. For this purpose use is made of measuring cylinders or gauges, which could drop into a bore, which has reached the desired size. However, for space reasons it is frequently impossible to use such a gauge.

SUMMARY OF THE INVENTION

An object of the invention is to provide a method, a honing machine and a tool, in which the readjustment of such a fixed set tool can be precisely controlled.

In the case of the method, during the main working stroke or a following levelling stroke, the measurement is performed.

Thus, this leads to no delay to the machining or working process and the measurement takes place over the entire work tool length and consequently gives an accurate picture of all the worked surfaces. The measurement is preferably carried out during the tool return stroke, in which the recalibration or levelling of the surface is performed. As the measurement is preferably performed with the tool rotating, each length and circumferential portion of the bore is covered.

The honing machine for performing the method has, apart from the measuring device, a control device, which brings about a comparison between the desired size, a permitted deviation therefrom and the actual value determined by the measuring device and then carries out the readjustment. This is only necessary after many individual working processes. However, as the working of the individual workpiece takes place relatively rapidly, a large number of pieces are produced per time unit and consequently automatic adjustment is appropriate.

The measuring device can be positioned outside the working area, which ensures that the measurement takes place following the actual machining It is preferably positioned on a non-widenable tool portion, so that there is a clear base value for the measurement The workpiece guide zone area is particularly suitable for the measurement. The front guide zone follows during the return stroke, during which the measuring device is preferably operable, so that the completely worked bore can be measured.

BRIEF DESCRIPTION OF THE DRAWINGS

These and further features of preferred developments of the invention can be gathered from the claims, description and drawings, in which the individual features can be realized in an embodiment of the invention and in other fields either singly or in the form of subcombinations and constitute advantageous constructions for which protection is hereby claimed. Embodiments of the invention are described hereinafter relative to the drawings, wherein:

FIG. 1 shows a longitudinal section through a tool according to the invention;

FIG. 2 shows a section view along line II—II in FIG. 1;

FIG. 3 shows the diagrammatic side view of a honing machine.

DESCRIPTION OF THE PREFERRED EMBODIMENTS

Figure 4:
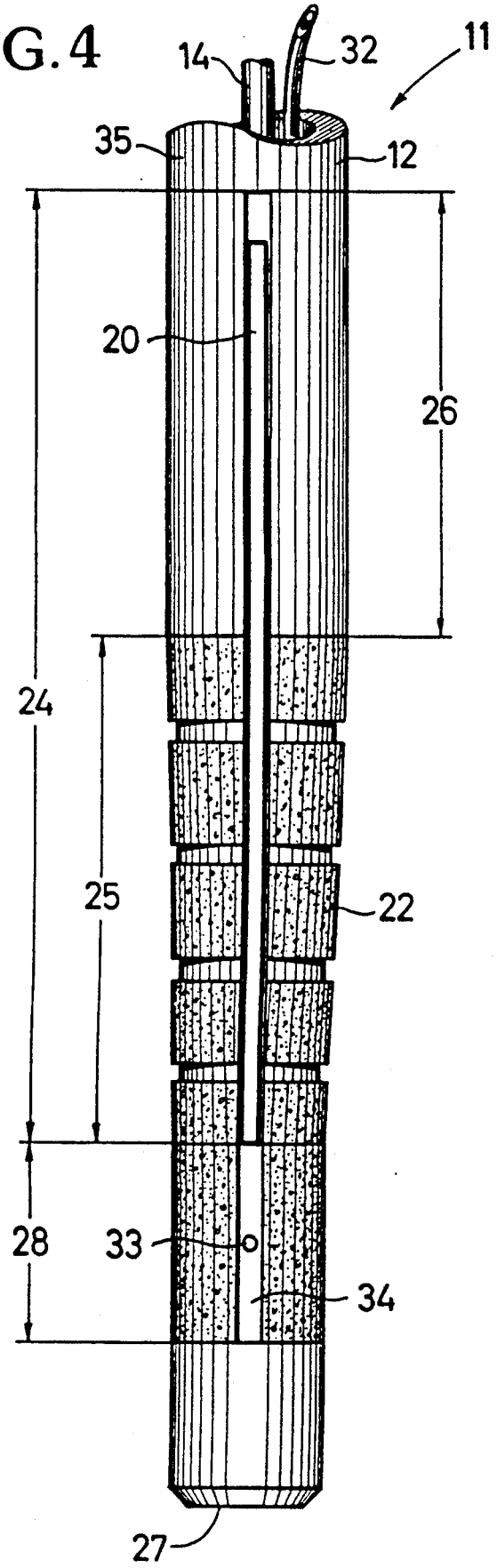
FIG. 4 shows another embodiment of the tool in side view.

FIG. 1 shows a honing tool 11 with an elongated, tubular tool body 12. The inner bore 13 of tool body 12 receives an adjusting body 14, which comprises a rod with a cone or taper 15 connected thereto and a front guide portion 16. The adjusting body 14 is adjustable in its axial position by an adjusting device 17. It comprises a threaded bolt 18, which is rotatable by means of a hexagonal rod 19 and moves the adjusting body in conjunction with a thread in the tool body.

The tool body is circumferentially provided with five slots 20, which extend radially outwards from its bore 13 and in which are guided honing strip or ledge carriers 21, which are covered on their outside by abrasive coatings 22. The honing strip carriers bevelled on their inside corresponding to the conical bevel are pressed against the same by two tubular springs 23.

The length of the abrasive coatings 22 determines the working area 24 in which material removal takes place. Most of the material is removed in the cutting zone 25 facing tool end 27 and which widens in the direction of the following calibrating zone 26. The latter is substantially cylindrical and serves to render uniform and improve the surface quality of the surface machined in the cutting zone.

Upstream of the cutting zone is provided a guide zone 28 on the tool body and which is constructed in strip or ledge-like manner in accordance with the honing strip carriers in the represented embodiment. Between the guide surfaces 29, the intrinsically circular tool body is flattened by chord-like surfaces. However, the guide zone could also comprise inserted guide strips comprising wear-resistant material or coated with the latter.

A measuring bore 30 passes longitudinally through the tool body and is connected at the spindle-side tool end, via a connection 31 to a measuring hose 32. The measuring bore leads to a measuring device 33 in the form of a nozzle, from which can pass air supplied through the measuring bore. The measuring nozzle is located in one of the chord-like portions 34 of the front guide portion 28 and is consequently set back somewhat behind the guide surfaces 28.

On the side of the honing strip carrier remote from the tool end 27 is provided a follow-up zone 35 corresponding to guide zone 28.

The machine 36 shown in FIG. 3 has a tool table 37, on which is mounted in a clamping mechanism 38 a workpiece 39 with a workpiece bore 40 to be machined.

The honing tool 11, e.g. that according to FIG. 1, is fixed in a chuck 41 of a work spindle 42, which is mounted so as to rotate and move up and down on the machine frame and can be driven in this way. The hexagonal rod 19 of the adjusting device 17 is connected by means of an adjusting rod 43 to a readjusting device 44, which e.g. has an electric stepping motor for rotating the rod 43.

The measuring hose 32 leads to a dynamic pressure air measuring device 45, which is supplied with compressed air by a line 46 and corresponding to the measured pressure of the air passing out of the nozzle 33 supplies signals to a comparator 47, which compares these signals corresponding to the actual size with the desired size set on an input device 48 and a permitted divergence also set thereon. If the permitted divergence is reached or exceeded, then by means of a release mechanism 49 a signal is supplied to the readjusting device 44, which rotates rod 43 by one or more steps, which can also be dependent on the size of the divergence. Thus, the setting body is pressed into the tool and a widening of the honing strip carrier takes place.

However, this widening or expansion does not take place several times per machining process, as in the case of conventional honing tools, but instead only every so often and frequently only after a large number of machining processes and then preferably during machining intervals, i.e. directly following the end of the measurement.

FIG. 4 shows a tool 11, which is a so-called shank tool. It comprises a tubular tool body, in which the honing coating 22 is applied directly to said body. The in this case very long working area 24 covers a widening cutting zone 25 interrupted by circular depressions and the cylindrical calibrating zone 26. In this area slots 20 are provided in the tool body and make the latter expandable to such an extent, that it can be widened in this area by an internal, conical adjusting body 14.

In the represented embodiment, the front guides zone 28 is also covered with an abrasive, particularly in order to hard-surface the same, but also, in the case of divergences in the preliminary working size, to be able to carry out a certain rough working for precise guidance purposes, whereby a longitudinally directed depression 44 is provided, within which is located the outlet for the air measuring device 33. It is connected via a longitudinal bore to the measuring hose 32.

Here again the measuring nozzle 33 is located in the non-widenable, front guide area. As in FIG. 1, it could also be located in the area of the rear guide zone 35 which, in the case of the tool according to FIG. 4 is formed by the tool body 12 and which is connected in a substantially stepless manner to the calibrating zone 26. As in any honing operation, it is a question of allowances of 1/100 to max. 1/10 mm, so that all the diameter differences are shown much larger than they are in fact. In operation, the individual zones are also not as clearly differentiated as there are also continuous transitions.

The method according to the invention is performed as follows. The honing tool 11 received in the work spindle 42 is set with its calibrating zone 26 to a size giving the desired size of bore 40. The tapering of the cutting zone towards the front end 27 of the tool is such that it corresponds to at least the diameter of the preworked bore. As this can never be very precise, the front guide zone 28 is appropriately made slightly conical, so that the tool can be perfectly guided with this zone in any pre-worked bore. Accompanied by rotation and supply of a corresponding honing oil, the tool works with its cutting zone into the bore and machines the same. Subsequently in the vicinity of the calibrating zone 26 the dimensional stability is produced, i.e. there is only a slight surface removal and a surface quality improvement. The following guide zone 35 ensures a reliable guidance int he bore, particularly so that the tool moved out of the bore at the bottom with virtually the entire working area can return in a completely satisfactory manner into the tool with its calibrating zone after ending the working stroke and reversing the stroke direction, without damaging the edges thereof. Correspondingly part of this guidance work can take place in the part covered by the abrasive, particularly int he case of the strip or ledge tool according to FIG. 1, where the cylindrical part of the calibrating zone 26 does not completely extend up to the upper end of the abrasive coating 22 and there is instead a slight diameter reduction there.

During the return stroke, air is blown out via air line 46, measuring device 45, measuring hose 32, bore 30 and the measuring nozzle, i.e. the actual measuring apparatus 33. Although during the return stroke the tool rotates and therefore the entire circumference and bore length are helically covered by the measuring tool, several nozzles can be arranged on the circumference to permit an even more accurate measurement. The measuring air is preferably connected in in controlled manner when the measuring nozzle 33 reenters the lower bore part.

After the measuring device has passed through the entire bore, the actual value is determined by the measuring device. As a function of the requirements, it is possible to use as the actual value a limit value, e.g. the indication of the minimum diameter during the complete measuring process, or even a more complicated value and this is supplied to the comparator. The latter compares the value set on the input device 48 for the desired value and the tolerance with the actual value and in the case of approximation or exceeding, via the release mechanism 49, e.g. a triac or relay, initiates a readjustment movement on the part of the readjusting device. Normally a stepwise setting is sufficient, because a single readjusting step is normally sufficient for several bores.

If the measuring device were fitted in the vicinity of guide zone 35 or at another point on this side of the working area, then the measurement could be performed directly following the forward stroke of the work cycle, or also during a levelling stroke.

The measuring device can also be provided for checking the pre-worked workpieces, in that in a manner not shown in the drawing the measuring mechanism 35, which also contains a switching device for the release of measuring air adapted to the working cycle, is connected with an additional device, which switches in the air supply when the tool enters the unmachined bore. If the measuring tool establishes a considerable undersize, the machining operation can be interrupted and the workpiece optionally removed. It is possible in this way to avoid tool damage due to incorrectly preworked workpieces. The measuring device is preferably positioned in the central part of the front guide zone 28. However, it can also be located on the front portion of said guide zone.

Figure 5:
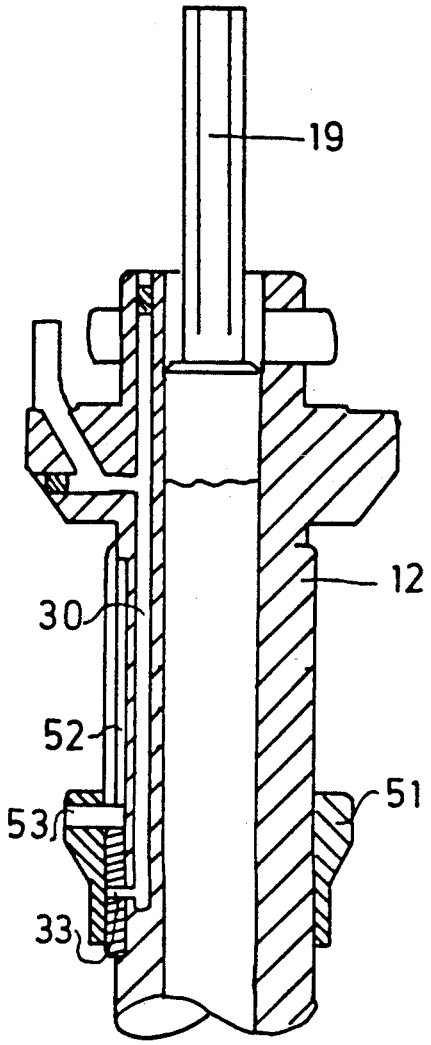
FIG. 5 shows, in simplified form and diagrammatically, the use of an air stagnation ring.

FIG. 5 shows in greatly simplified and diagrammatic manner another honing tool with a tool body 12 and a hexagon 19 for widening or expanding the tool. No details are shown with regards to the widening and the honing. As in the previous embodiments, the tool body 12 contains a line 30, through which air is blown to a nozzle 33.

The tool body 12 has an air stagnation ring 51, which is mounted in sliding manner on the tool body 12 and can be displaced between two end positions. For limiting the movement of the air stagnation ring 51, the tool body has a longitudinally directed slot 52, in which engages a pin 53. Pin 53 is fixed to ring 51 in such a way that it projects over the inside of the ring and engages in slot 52. The length and arrangement of the slot consequently determined the limits of the displacement range of the air stagnation ring 51.

In the lower position of the air stagnation ring 51 shown in FIG. 5 and in which the ring drops as a result of gravity, it covers the nozzle 33 of the air measuring device, so that there is no compressed air drop in line 30 and the associated air measuring system. If the tool is now inserted in a bore to be machined, then the bore edge moves upwards the air stagnation ring 51 with respect to the tool body 12, so that nozzle 33 is released at the instant in which the tool body 12 is inserted in the bore of the workpiece to be machined. Through preventing the free outflow of air from nozzle 33, if the latter is not in the workpiece, it is possible to achieve a faster measurement or an earlier readiness of the apparatus to measure. The distance between the inside of the air stagnation ring 51 and the nozzle 33 can be greater than 0, i.e. it need not be an airtight closure. It is particularly favourable if the distance is chosen in such a way that it corresponds to the nominal diameter of the bore to be machined. There is then a minimum pressure divergence during the covering of nozzle 33 compared with the pressure within the tool. In addition, the air stagnation ring 51 can be used for calibrating the measuring device between two measurements or in longer intervals. The engagement of pin 53 in slot 52 is also used for ensuring that the nozzle 33 always faces the same point of the air stagnation ring 51.

As the distance between the air stagnation ring 51 and the nozzle 33 can be greater than 0, said ring 51 can also be used for a nozzle 33 positioned at the front end of tool body 12, such as e.g. the case in the embodiment of FIG. 1.

We claim:

1. A honing tool, comprising:

a widenable honing surface having a work area for removing material from a machining surface of a workpiece, said honing surface having a widening cutting zone and a calibrating zone which can be preset in a fixed manner prior to start of machining to correspond to the desired size of the machining surface;

measuring means positioned outside said work area, said measuring means having at least one nozzle;

a dynamic pressure air measuring device connected by a line in the tool to said nozzle; and an air stagnation ring displaceably mounted on said tool, said ring being moved automatically on said tool to cover said at least one nozzle when said at least one nozzle is not positioned in said workpiece.

2. Honing tool according to claim 1, wherein the measuring means is positioned in a non-widenable tool portion.

3. Honing tool according to claim 1, wherein the measuring means is provided in the vicinity of a guide zone of the tool.

4. Honing tool according to claim 3, wherein the measuring means are provided in a guide zone connected upstream of the cutting zone during a main working stroke.

5. Honing tool according to claim 1, wherein during a return part of a single main working stroke of the tool (11), the measuring means (33) are activated.

6. Honing tool according to claim 1, wherein the nozzles are located in depressions of a guide zone.

7. Honing tool according to claim 1, wherein the nozzles are positioned between longitudinally directed guide surfaces or strips.

8. A honing tool according to claim 1, wherein a radial spacing between said at least one nozzle and said air stagnation ring is greater than 0.

9. A honing machine comprising:

a tool having a widenable honing surface, said honing surface having a work area for removing material from a machining surface of a workpiece during a work cycle, whereby the machining surface is machined from a preliminary surface size and surface quality to a desired surface size and surface quality during said work cycle;

a work spindle adapted to receive said tool and to drive said tool rotationally and vertically;

measuring means connected to said tool for measuring the size of the machining surface after the removal of said material, the measuring means being axially spaced from said work area in a non-widenable portion of the tool;

comparator means connected to said measuring means for comparing a predetermined desired size and permitted diversion from said desired size with said size determined by said measuring means and creating an output signal dependent on said comparison;

readjusting means for resetting said honing surface prior to starting the working cycle in a fixed position and housing said honing surface in said position during the working cycle;

release means initiating the readjusting means to readjust the honing surface of the tool between two working cycles, said release means being initiated by said output signal and a displaceable element which is moved automatically in front of the measuring means when said measuring means is not located in the workpiece.

10. A honing tool comprising:

a widenable honing surface having a work area for removing material from a machining surface of a workpiece during a work cycle, said work area having an axially widening cutting zone and a calibrating zone, said cutting zone and said calibrating zone being located in an axial direction of the honing tool adjacent to each other, said calibrating zone being adapted to be preset in a fixed position, corresponding to the desired size for the machining surface and being held in said preset fixed position during the working cycle; measuring means axially spaced from said work in a non-widenable portion of said tool; and a displaceable element which is moved automatically in front of the measuring means when said measuring means is not located in the workpiece.

* * * * *

UNITED STATES PATENT AND TRADEMARK OFFICE

CERTIFICATE OF CORRECTION

PATENT NO. : 5,088,237

DATED : February 18, 1992

INVENTOR(S) : NAGEL et al.

It is certified that error appears in the above-identified patent and that said Letters Patent is hereby corrected as shown below:

Column 4, line 10, replace "int he" with --in the--.
line 18, replace "int he" with --in the--.
Column 6, line 40, replace "resetting" with --presetting--.
line 42, replace "housing" with --holding--.

Signed and Sealed this

Twentieth Day of April, 1993

*Attest:*

*Attesting Officer*

MICHAEL K. KIRK

*Acting Commissioner of Patents and Trademarks*